US007552890B1

(12) United States Patent
Gipson

(10) Patent No.: US 7,552,890 B1
(45) Date of Patent: Jun. 30, 2009

(54) TENSION ENHANCER FOR WHEEL-TYPE TENSIONER

(75) Inventor: Tommie Carroll Gipson, Eaton, CO (US)

(73) Assignee: RRI Holdings, Inc., Dallas, TX (US)

( * ) Notice: Subject to any disclaimer, the term of this patent is extended or adjusted under 35 U.S.C. 154(b) by 0 days.

(21) Appl. No.: 12/156,756

(22) Filed: Jun. 4, 2008

(51) Int. Cl.
*B62H 20/02* (2006.01)

(52) U.S. Cl. ..... 242/564.4

(58) Field of Classification Search ..... 166/77.2; 175/162; 242/564.4; 226/186
See application file for complete search history.

(56) References Cited

U.S. PATENT DOCUMENTS 4,673,035 A * 6/1987 Gipson ..... 166/77.1
5,765,643 A * 6/1998 Shaaban et al. ..... 166/384
5,839,514 A * 11/1998 Gipson ..... 166/384
6,491,107 B2 * 12/2002 Dearing et al. ..... 166/381
6,672,394 B2 * 1/2004 Neal ..... 166/379
7,152,672 B1 * 12/2006 Gipson ..... 166/77.2

* cited by examiner

*Primary Examiner*—William P Neuder
*Assistant Examiner*—Nicole Coy
(74) *Attorney, Agent, or Firm*—Elizabeth R. Hall

(57) ABSTRACT

A device for applying tension to a string of coiled tubing for the purpose of its insertion into or withdrawal from a wellbore. Specifically, the device is used with a wheel-type tensioner, which contacts and supports the tubing over an arc length of less than 180°. The device enhances the tractive ability of the tensioner by applying forces normal to the tubing to press it into more intimate contact with the surface of the wheel, thereby increasing the normal force and attendant frictional force between the tubing and the wheel.

20 Claims, 10 Drawing Sheets

TENSION ENHANCER FOR WHEEL-TYPE TENSIONER

BACKGROUND OF THE INVENTION

1. Field of the Invention

The present invention relates to a method and apparatus for applying tension to a string of coiled tubing during its injection into and withdrawal from a well bore. More particularly, the invention relates to a device used with a wheel-type tensioner, which contact and supports the tubing over an arc length of less than 180°.

2. Description of the Related Art

Currently wheel-type tensioners are commonly used with coiled tubing employed in servicing petroleum wells. For such devices, the tubing is stored on a large reel and is then passed over a tensioning wheel before entering the wellbore. The tubing only contacts the wheel of the tensioner over an arc length of less than 180° and typically less than 90°.

The wheel provides a turning function for the tubing so that it can be routed between the well bore and the storage reel, but the wheel can also provide tensioning capability if motive torque is applied. However, when the tubing must be forced into the well through a sealing gland and against well pressure or when the tubing must be withdrawn from the well, the ability of the wheel to apply motive tension to the tubing is limited.

The tension which can be applied by the simple wheel tensioner is controlled by the length of arc contact, the tubing tensions entering and leaving contact with the wheel, and the coefficient of friction of the tubing with the wheel. These limitations are particularly important when only a short length and weight of tubing are in the well.

A need exists for a means of enhancing the radial contact forces and resultant frictional forces between the tubing and the wheel of the tensioner. A further need exists for a simplified and cost-effective means for enhancing the radial contact forces and resultant frictional forces between the tubing and the wheel of the tensioner.

SUMMARY OF THE INVENTION

This invention pertains to a device for applying tension to a string of coiled tubing for the purpose of its insertion into or withdrawal from a wellbore. Specifically, the device is used with a wheel-type tensioner, which contacts and supports the tubing over an arc length of less than 180°. The device enhances the tractive ability of the tensioner by applying forces normal to the tubing to press it into more intimate contact with the surface of the wheel, thereby increasing the normal force and attendant frictional force between the tubing and the wheel.

One embodiment of the present invention includes a wheel tensioner assembly for applying tension to a string of coiled tubing during its injection into and withdrawal from a wellbore, the wheel tensioner assembly comprising: a selectably rotatable tensioner wheel having a circumferential contact surface for interacting with a first side of the coiled tubing; a holddown device having a plurality of contact rollers that interact with a second side of the coiled tubing; and a biasing mechanism for urging said contact rollers radially inwardly to bear against the second side of the coiled tubing and press the coiled tubing against the circumferential contact surface of the tensioner wheel.

A second embodiment of the present invention includes a wheel tensioner assembly for applying tension to a string of coiled tubing during its injection into and withdrawal from a wellbore, the wheel tensioner comprising: a tensioner wheel having a circumferential contact surface for interacting with a first side of the coiled tubing; a rotation mechanism for selectably applying torque to the tensioner wheel; a holddown device attached to the tensioner wheel, the holddown device having a plurality of contact rollers positioned radially outward of the circumferential contact surface, wherein the contact rollers interact with a second side of the coiled tubing; and means for urging the contact rollers radially inwardly to apply a force normal to the second side of the coiled tubing.

Another embodiment of the present invention includes a wheel tensioner assembly for applying tension to a string of coiled tubing during its injection into and withdrawal from a wellbore, the wheel tensioner comprising: a tensioner wheel rotatably mounted on a wheel pedestal, wherein the tensioner wheel has a rim, a shaft, a wheel sprocket mounted on the shaft, and a circumferential arcuate contact surface for interacting with a first side of the coiled tubing; a tensioner drive motor; a tensioner drive chain positioned about a circumference of the wheel sprocket and driven by the tensioner drive motor, wherein the drive chain causes the tensioner wheel to rotate whenever the drive chain is driven by the drive motor; a holddown device attached to the shaft of the tensioner wheel, the holddown device having a plurality of roller mounting structures, wherein each roller mounting structure mounts a contact roller and positions the contact roller radially outward of the circumferential contact surface; and a biasing mechanism for urging said contact rollers radially inwardly to bear against a second side of the coiled tubing and press the coiled tubing against the circumferential contact surface of the tensioner wheel.

Yet another embodiment of the present invention includes a wheel tensioner assembly for applying tension to a string of coiled tubing during its injection into and withdrawal from a wellbore, the wheel tensioner comprising: (a) a selectably rotatable tensioner wheel having an exterior circumferential contact surface for interacting with a first side of the coiled tubing; and (b) a holddown device attached to a shaft of the tensioner wheel, the holddown device comprising a plurality of roller mounting structures, wherein each roller mounting structure mounts a contact roller and positions the contact roller radially outward of the circumferential contact surface and wherein a first end sheave is mounted on each roller mounting structure on a first side of the contact roller and a second end sheave is mounted on an opposed side of each contact roller; and a selectably engaged biasing mechanism for urging said contact rollers radially inwardly to bear against a second side of the coiled tubing and press the coiled tubing against the circumferential contact surface of the tensioner wheel, wherein the biasing mechanism includes a first tensioning cable in communication with the first end sheave and a second tensioning cable in communication with the second end sheave.

The foregoing has outlined rather broadly several aspects of the present invention in order that the detailed description of the invention that follows may be better understood and thus is not intended to narrow or limit in any manner the appended claims which define the invention. Additional features and advantages of the invention will be described hereinafter which form the subject of the claims of the invention. It should be appreciated by those skilled in the art that the conception and the specific embodiment disclosed may be readily utilized as a basis for modifying or designing of the structures for carrying out the same purposes as the invention. It should be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENTS

Figure 1:
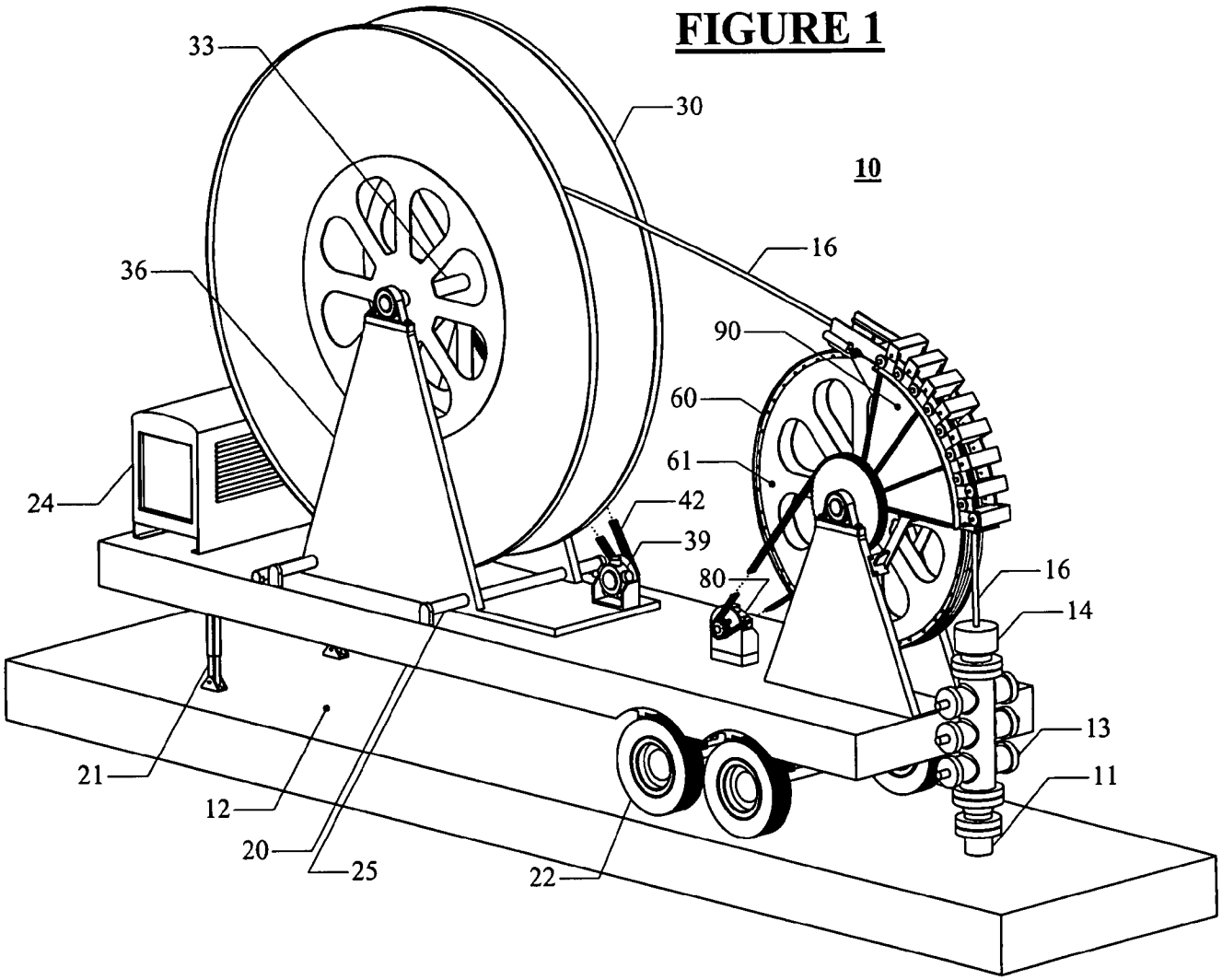
FIG. 1 is an oblique view of a coiled tubing unit employing the tension enhancement means of the present invention.
Figure 2:
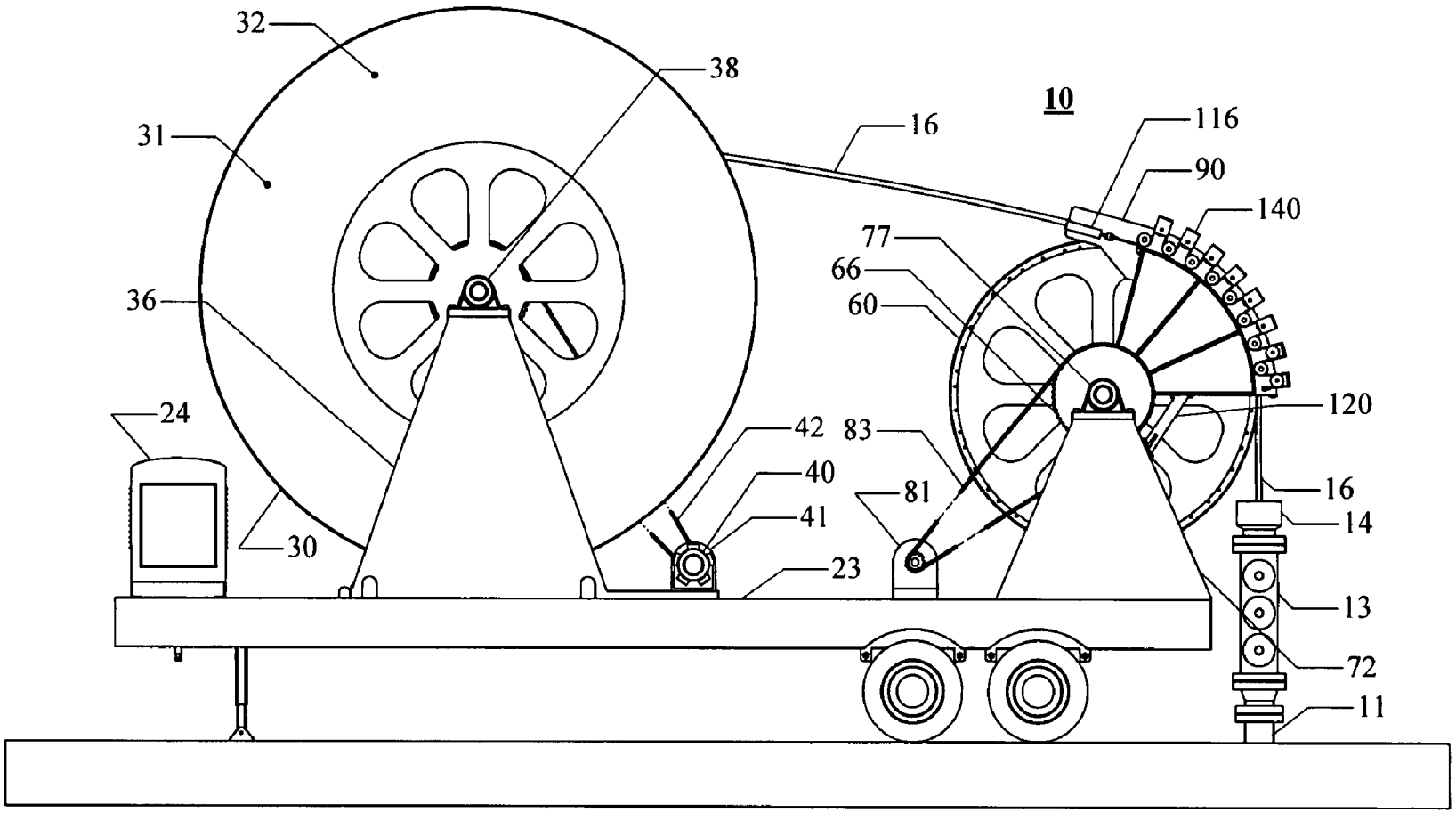
FIG. 2 is a left side profile view of the coiled tubing unit of FIG. 1.
Figure 3:
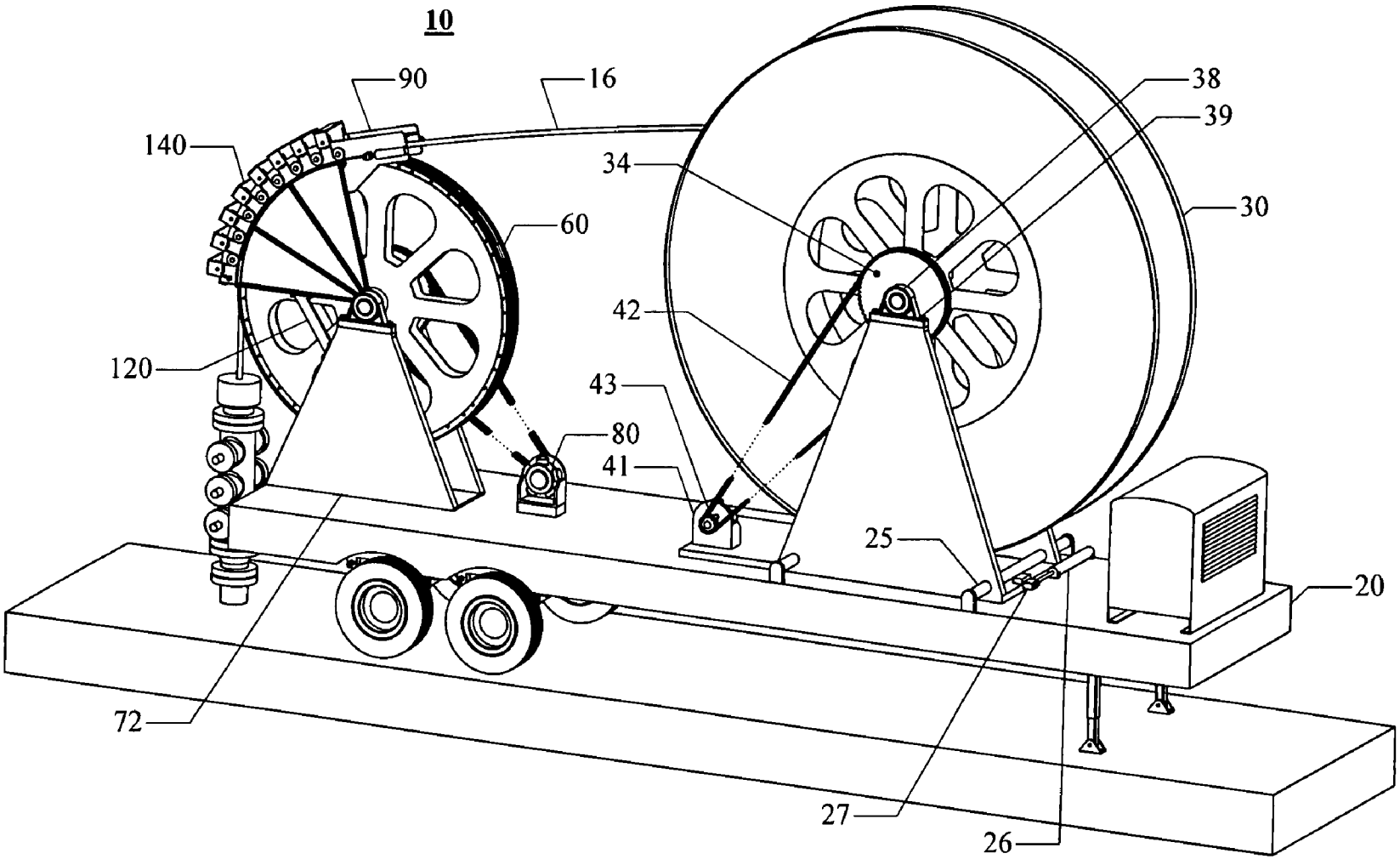
FIG. 3 is an oblique right side view of the coiled tubing unit of FIG. 1.
Figure 4:
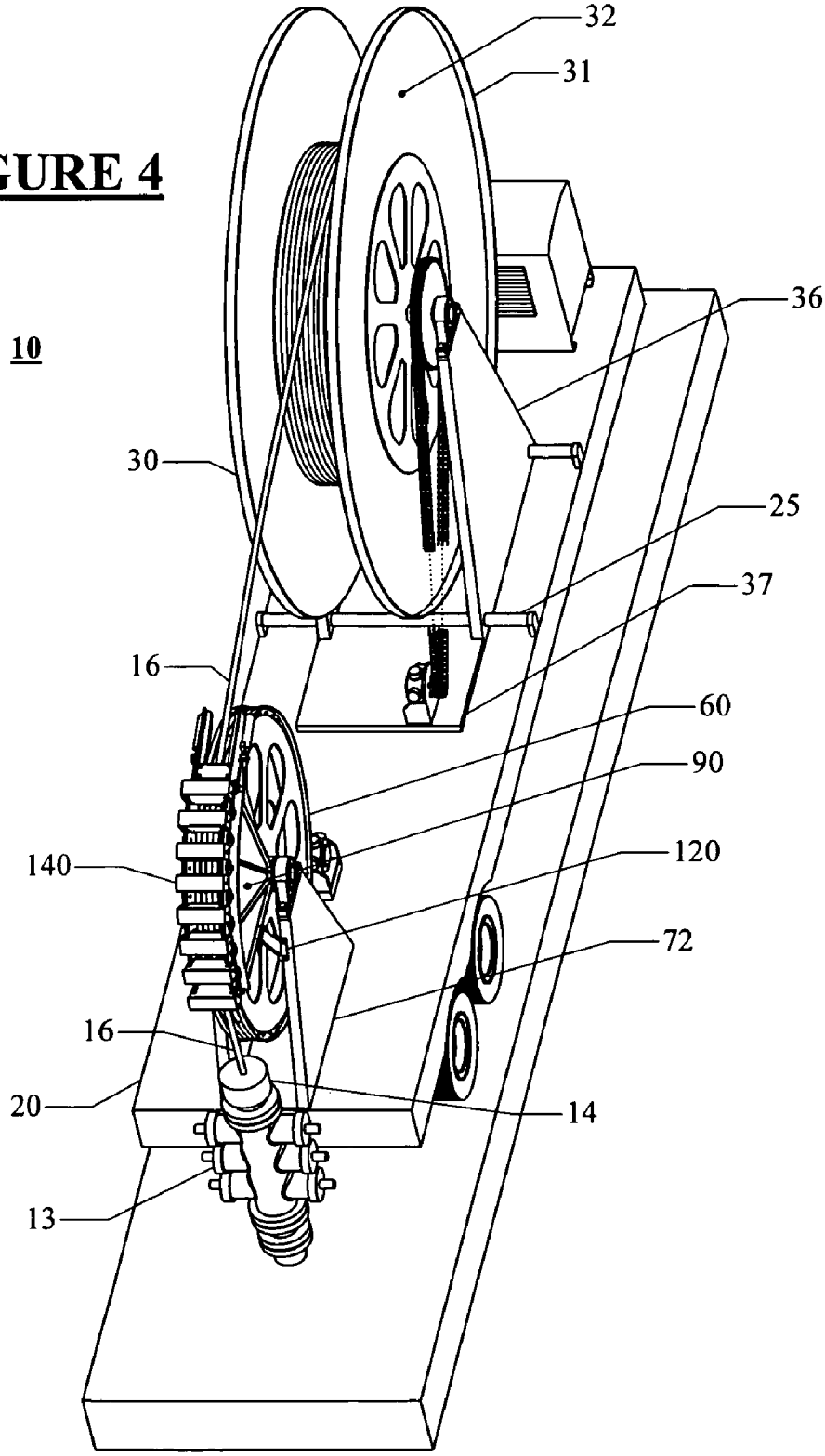
FIG. 4 is an oblique rear view of the coiled tubing unit of FIG. 1.

As a note, the use of the terms "invention", "present invention" and variations thereof throughout the subject patent application (and headings therein) are intended to refer or relate to one or more embodiments of the present application, not necessarily every embodiment or claim of the application.

Referring now to the drawings, it is noted that like reference characters designate like or similar parts throughout the drawings. The figures, or drawings, are not intended to be to scale. For example, purely for the sake of greater clarity in the drawings, wall thicknesses and spacings are not dimensioned as they actually exist in the assembled embodiments.

The materials of construction of the structural components of the trailer, the storage reel, the wheel tensioner, and the tension enhancement device of the present invention are generally steel, but other materials may be used in certain cases. The support pads for the tensioner wheel are also typically made of steel, but other materials, such as high durometer polyurethane, can be substituted. Bearings used for the device will generally be ball, cylindrical, or spherical roller bearings.

Coiled Tubing Unit

Referring to FIGS. 1 through 4, the arrangement of the coiled tubing unit 10 employing the wheel tensioner 60 and its integral tension enhancement means of the present invention are shown in various views. The coiled tubing unit 10 typically is trucked to a well location and parked on the ground surface aligned with a well 11. The well 11 generally is an oil or gas or injection well, but it could also be a water well. The well 11 is cased with one or more strings of tubular casing and normally can contain some internal pressure. The well 11 may also have tubing in place substantially coaxial with the casing.

When the well 11 is being serviced by the coiled tubing unit 10, a set of one or more blowout preventers 13 and a pressure-containing stripping gland 14 are mounted on the upper end of the well, with the gland mounted above the blowout preventers. The stripping gland 14 is of conventional oilfield construction, and has a steel housing and an annular rubber element mounted therein. The rubber element of stripping gland 14 is biased to bear against the outer cylindrical surface of any tubing 16 inserted and axially reciprocated through its bore.

The coiled tubing unit 10 has a storage reel 30 and the wheel tensioner 60 mounted on the deck 23 of a trailer 20. The wheel tensioner 60 is at the rear end of the trailer 20, and the storage reel 30 is near the front end. Trailer 20 is supported at its front end by selectably vertically extensible and lockable jacks 21 when it is not supported by the fifth wheel of a truck (not shown). At its rear end, trailer 20 is supported by two spring mounted axles 22 with tires. Although it is not shown in the figures, supplementary vertically extensible and lockable jacks may also be used to support the rear end of trailer 20 on the ground 12 so that it is more rigidly mounted when high coiled tubing tensions are to be expected.

A unitized power unit 24, including an engine and a hydraulic pump with a reservoir, is mounted at the forward end of deck 23 of the trailer 20. The hydraulic power from the pump of the power unit 24 is used to drive the hydraulic motors 40 and 80, which respectively drive the storage reel 30 and the wheel tensioner 60, and the level wind hydraulic cylinder 26. For clarity, the controls and hydraulic connections are omitted from the drawings herein, but are well understood by those skilled in the art of oilfield equipment.

Storage Reel

The storage reel 30 is translatable laterally across the deck 23 of the trailer 20 in order to provide levelwinding of the tubing 16 stored on the reel. Right circular cylindrical rods 25 extending athwart the trailer 20 and mounted at their distal ends by vertical plates attached to the trailer deck 23 serve as levelwind guide rails for the storage reel 30. A transversely mounted levelwind hydraulic actuation cylinder 26 is attached to the deck 23 of the trailer 20. The rod of cylinder 26 has a rod end attachment 27 which in turn is attached to the base 37 of the reel pedestal 36 of the storage reel 30.

The storage reel unit 30 consists of a reel 31, a reel pedestal 36, and rotational drive means. The reel 31 is symmetrical about its axis of rotation and has a hollow right circular plate core upon which the end of the coiled tubing string 16 is anchored. The core (not shown) provides a surface upon which the base layer of the tubing 16 can be levelwound.

At the transverse ends of the reel core are located two opposed reel flanges 32 having planar inner faces. The reel flanges 32 have circumferential rims and may be fitted with radial stiffeners, although that is not shown herein. The reel flanges extend inwardly to where they are welded to a right circular cylindrical reel shaft 33. The reel shaft 33 extends outwardly of the reel flanges 32 and has a large fixedly mounted concentric driven chain sprocket 34 on one side. The width of the reel 31 is usually slightly less than half of the width of the trailer 20, so that laterally translating the reel by levelwinding permits the tubing to be controllably wound on the reel core over its entire width.

The reel pedestal 36 serves to support the reel 31. The reel pedestal 36 consists of a horizontal base 37 with two opposed parallel antisymmetrical trapezoidal vertical side buttresses extending upwardly at its sides. The gap between the side buttresses is sufficient to accommodate the reel 31. Coaxial holes penetrate each of the side buttresses perpendicular to the side buttresses in two places and serve to journal the levelwind guide rails 25.

The reel pedestal 36 is mounted so that the side buttresses extend parallel to the sides of the trailer 20. The upper horizontal surface of each of the trapezoidal side buttresses serves as a mounting surface for a pillow block 38 with an integral roller bearing. The pillow blocks 38 journal the reel shaft 33 of the reel 31 and are attached to the reel pedestal 36 by mounting bolts 39. Selectably extending and retracting the rod of the hydraulic levelwind actuation cylinder 26 causes the storage reel unit 30 to traverse the guide rails 25 in order to effect levelwinding of the tubing 16 on the reel 31.

The reel 31 is caused to rotate by a rotary hydraulic reel drive motor 40 attached to a reel drive motor mount 41, which is in turn mounted to the reel pedestal base 37. The shaft of the reel drive motor 40 is perpendicular to the side of the trailer 20 and mounts a reel drive chain sprocket 43. The reel drive chain sprocket 43 is coplanar with the reel driven sprocket 34 mounted on the reel 31. A heavy duty reel drive roller chain 42 is looped around and engaged with both the reel drive sprocket 43 and the reel driven sprocket 34. This permits rotation of the reel drive motor 40 to be transmitted to the reel 31. The levelwinding action of the levelwind cylinder 26 for the storage reel unit 30 is coordinated with the reel rotation either manually or with automatic controls.

Wheel Tensioner

Figure 5:
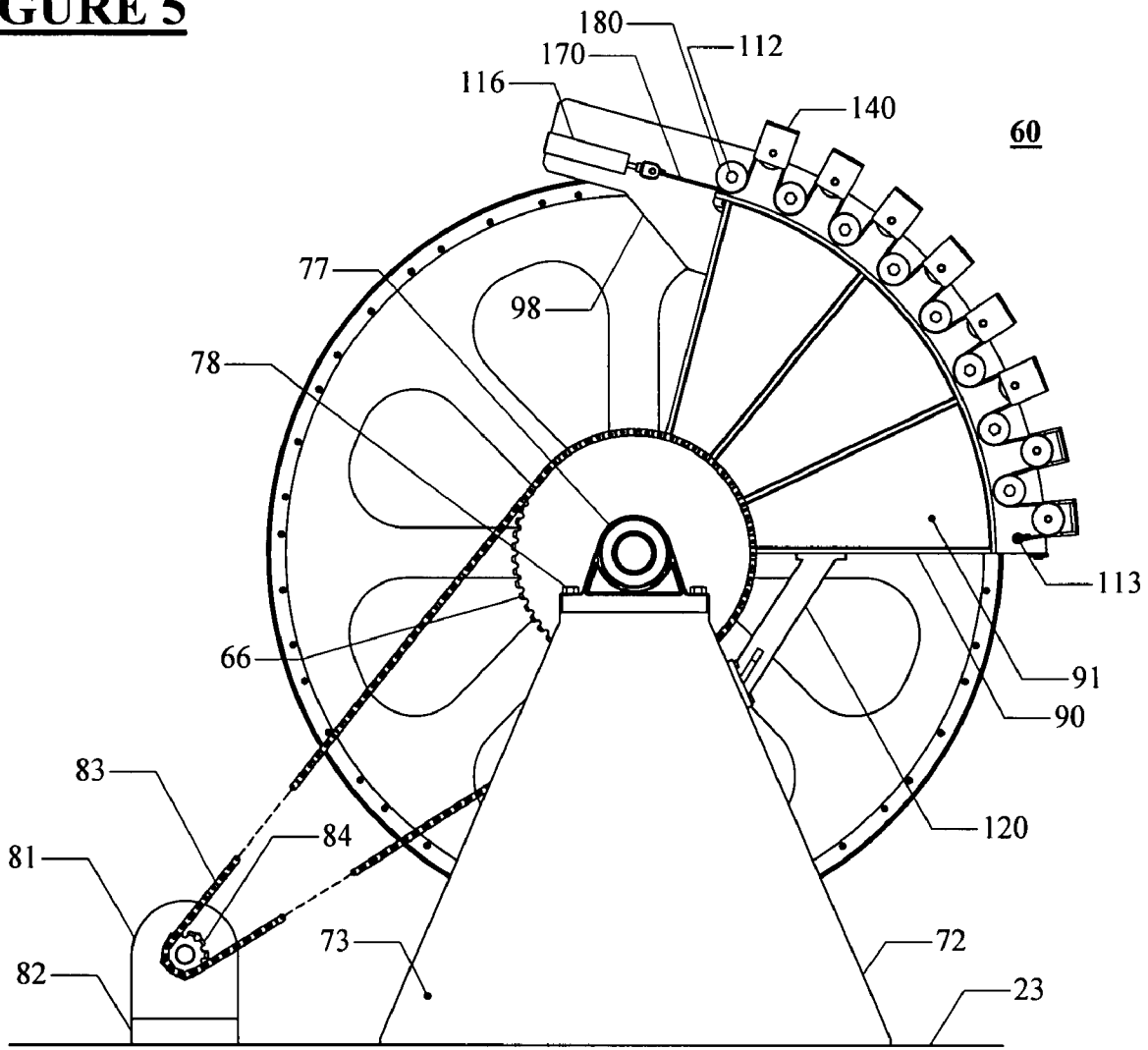
FIG. 5 is a left side profile view of the wheel tensioner employing the tension enhancement means of the present invention.
Figure 6:
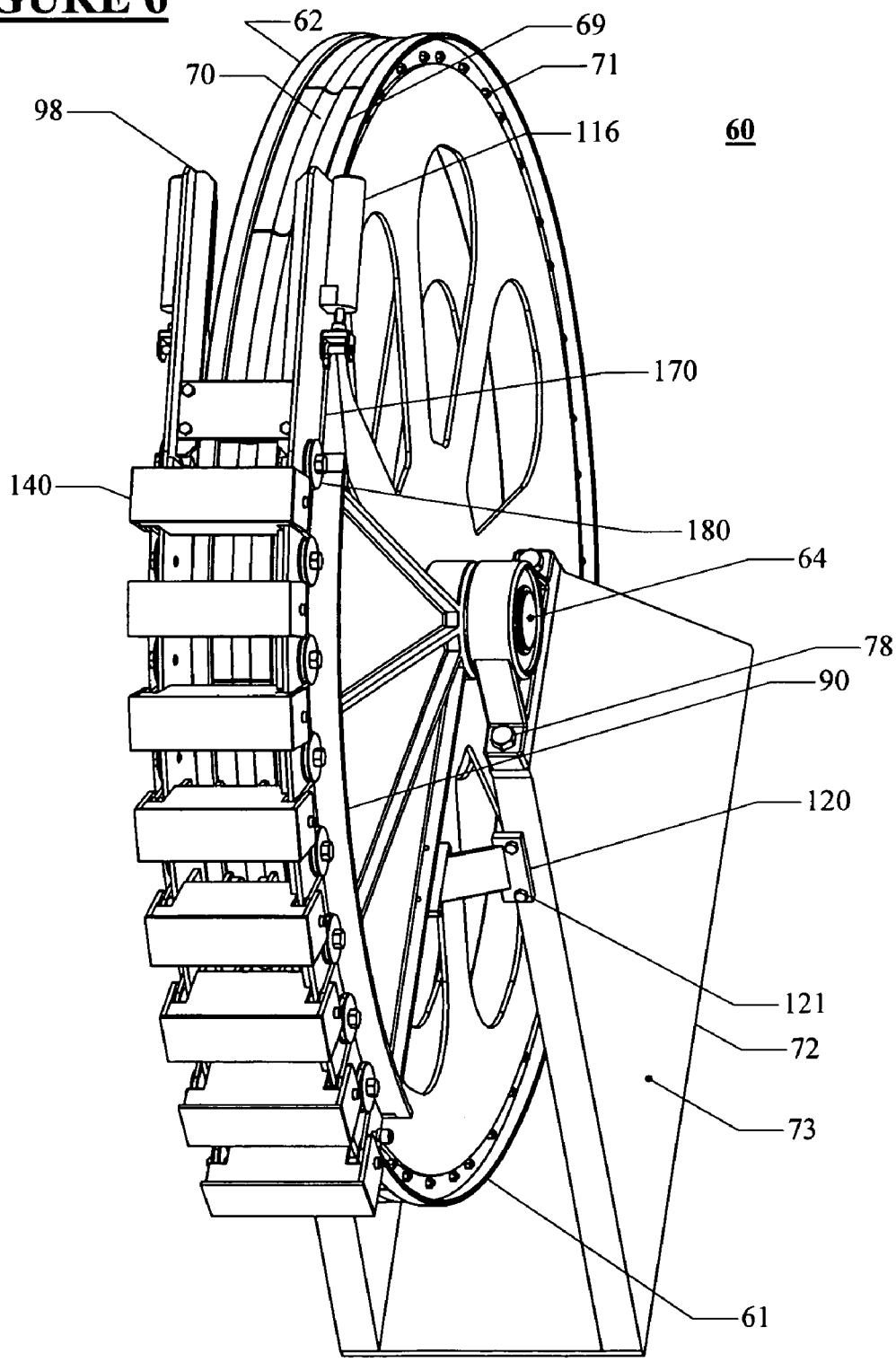
FIG. 6 shows an oblique rear view of the wheel tensioner of FIG. 5.
Figure 7:
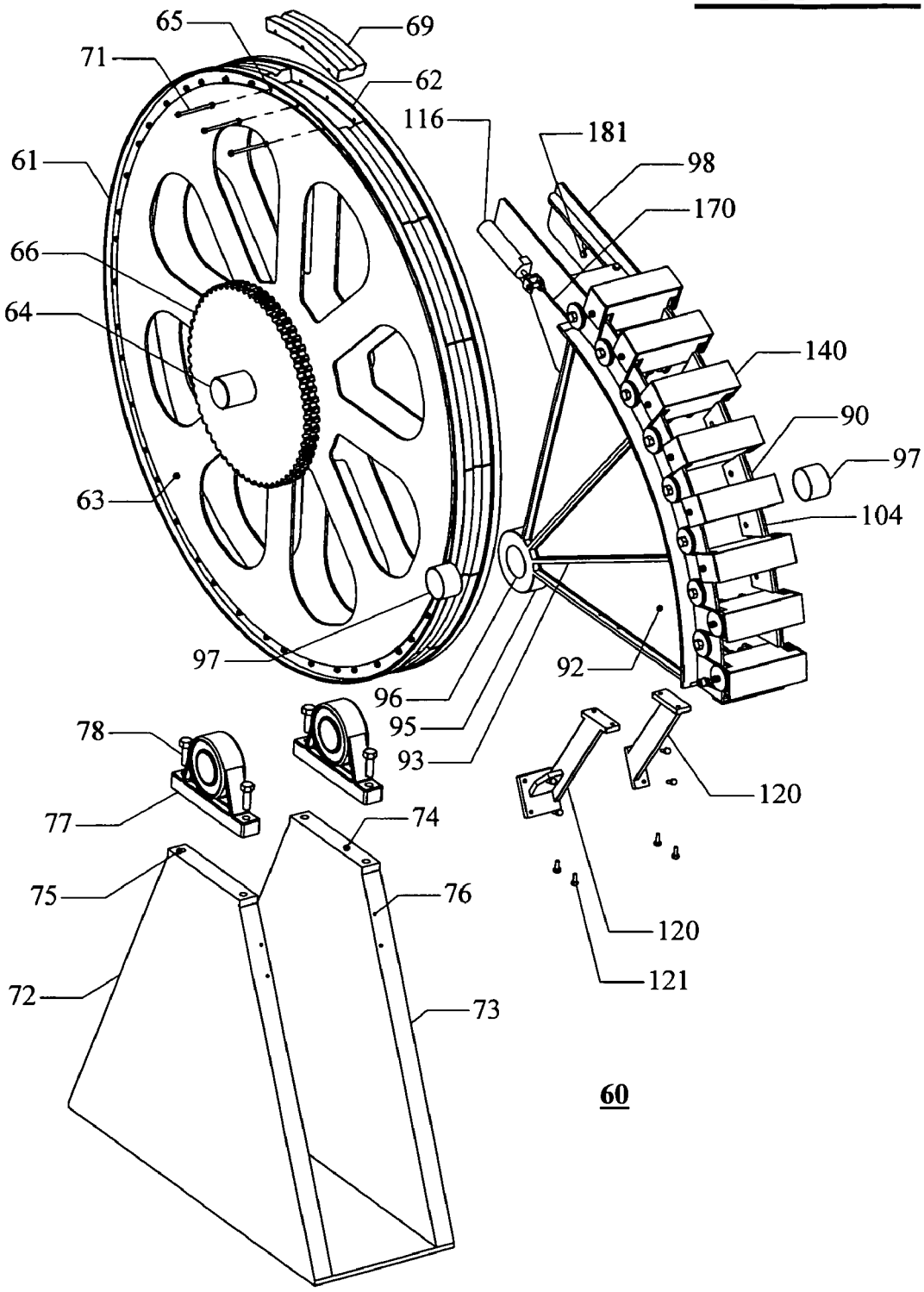
FIG. 7 is an exploded oblique rear view of the wheel tensioner of FIGS. 5 and 6.

The wheel tensioner 60 for the coiled tubing unit 10 mounted on the trailer 20 is shown assembled in FIGS. 5 and 6, while FIG. 7 shows an exploded view of the wheel tensioner. The wheel tensioner 60 consists of a wheel subassembly 61, a pedestal subassembly 72, rotational drive means, and a tubing holddown device 90. The wheel tensioner 60 has its narrow wheel 61 subassembly supported on its wheel pedestal 72, with the transverse midplane of the wheel subassembly fixedly located on the longitudinal centerline of the trailer 20.

The wheel tensioner 60 is positioned so that the coiled tubing 16 can pass smoothly between the wheel 61 and the storage reel 30, making tangential contact with both. The wheel tensioner is also positioned so that the coiled tubing 16 can pass vertically between the wheel tensioner 60 and the pressure retaining gland 14 mounted on the blowout preventers 13 and the wellhead 11. In order to provide room for the blowout preventers 13, the tangential entry/exit point on the rear side of the tensioner wheel 60 is positioned to the rear of the trailer 20. The tubing holddown device 90, which does not rotate and serves as a tension enhancement device for the wheel tensioner 60, is mounted directly to the shaft 64 of the wheel 61 of the wheel tensioner 60.

The wheel subassembly 61 is symmetrical about its axis of rotation and has a U-shaped cross-section wheel rim 62 with the U opening radially outwardly and having small outwardly extending circumferential outer flanges. The wheel rim 62 is symmetrical about the transverse midplane of the wheel 61.

An axially symmetric regularly spaced pattern of rim holes 65 are positioned offset from and parallel to the wheel axis so that they coaxially penetrate the transverse sides of the U of the wheel rim 62. The rim holes 65 permit the mounting of tubing support blocks 69. At the opposed outer transverse sides of the U of the rim 62 are located two flat circular annular plate wheel side plates 63, which are welded to the sides of the rim 62. The side plates 63 have a regularly spaced pattern of large lightening holes cut between their inner bore and outer periphery. The side plates may be fitted with radial stiffeners, although that is not shown herein.

A right circular cylindrical elongated wheel shaft 64 is closely fitted coaxially and welded to the center hole in each of the side plates 63. The wheel shaft 64 extends axially farther outwardly on one side than the other in order to accommodate the attachment of the driven chain sprocket 66 for the wheel subassembly.

A set of arcuate tubing support blocks 69 have a close fit to the outwardly opening U of the wheel rim 62. A tubing support block 69 has a semicircular outwardly opening annular tubing support groove 70 cut in its outer cylindrical face so that it can provide a loose fit to the tubing 16 to be accommodated by the wheel tensioner 60. Each tubing support block 69 has one or more holes positioned offset from and parallel to the axis of symmetry of the block so that they can be mated with the rim holes 65 of the wheel rim 62 when the block is nested in the U of the wheel rim. A bolt and nut set 71 is then engaged through each rim hole 65 to retain the set of tubing support blocks 69.

The wheel pedestal 72 serves to support the wheel 61. The wheel pedestal 72 consists of a horizontal base with two opposed parallel antisymmetrical trapezoidal vertical side buttresses extending upwardly at its sides. The gap between the side buttresses is sufficient to accommodate the wheel 61, the holddown device 90, and the driven wheel sprocket 66 attached to the wheel shaft 64.

The wheel pedestal 72 is mounted so that the side buttresses extend parallel to the sides of the trailer 20. The upper horizontal surface of each of the trapezoidal side buttresses 73 serves as a mounting surface 74 for a pillow block 77 with an integral roller bearing. The pillow blocks 77 journal the wheel shaft 64 of the wheel 61 and are attached to the wheel pedestal 72 by pillow block mounting bolts 78 engaged in drilled and tapped bearing mounting holes 75 in the mounting surfaces 74. On the rearward inclined faces of each of the side buttresses 73 of the wheel pedestal 72 are located a regular pattern of drilled and tapped holes 76 which serve to mount a knee 120 to each of the buttresses.

The wheel 61 is caused to rotate by a rotary hydraulic tensioner drive motor 80 attached to a tensioner drive motor mount 81 mounted to a horizontal tensioner motor mount spacer 82, which is in turn mounted to the deck 23 of the trailer 20 forward of the wheel assembly 60. The shaft of the tensioner drive motor 80 is perpendicular to the side of the trailer 20 and mounts a tensioner drive chain sprocket 84. The tensioner drive chain sprocket 84 is coplanar with the wheel driven sprocket 66 mounted on the wheel 61. A heavy duty tensioner wheel drive roller chain 83 is looped around and engaged with both the tensioner drive sprocket 84 and the wheel driven sprocket 66. This permits rotation of the tensioner drive motor 80 to be transmitted to the wheel 61.

Holddown Device

The holddown device 90 and its constituent components are shown in FIGS. 7 through 14. The holddown device functions to cause the coiled tubing passing over the tensioner wheel 61 to be more forcefully pressed against the annular groove of the tubing support blocks 69. This additional radially inward force thereby enhances the possible magnitude of the circumferential frictional shear forces developable between the support blocks 69 and the tubing 16, in turn permitting higher forces to be applied to the tubing going into or emerging from the pressure retaining gland 14.

The holddown device 90 consists of two interconnected mirror image side frames 91 mounting a series of pulldown roller assemblies 140 and means for biasing the pulldown roller assemblies radially inwardly towards the rotational axis of the wheel tensioner. The holddown device 90 has one of its side frames on each side of the wheel 61 of the wheel tensioner 60. The pulldown roller assemblies 140 are set radially outwardly from the contact blocks of the wheel 61. The holddown device does not rotate, but is journaled about the wheel shaft 64 of the wheel 61 of the wheel tensioner 60.

Figure 9:
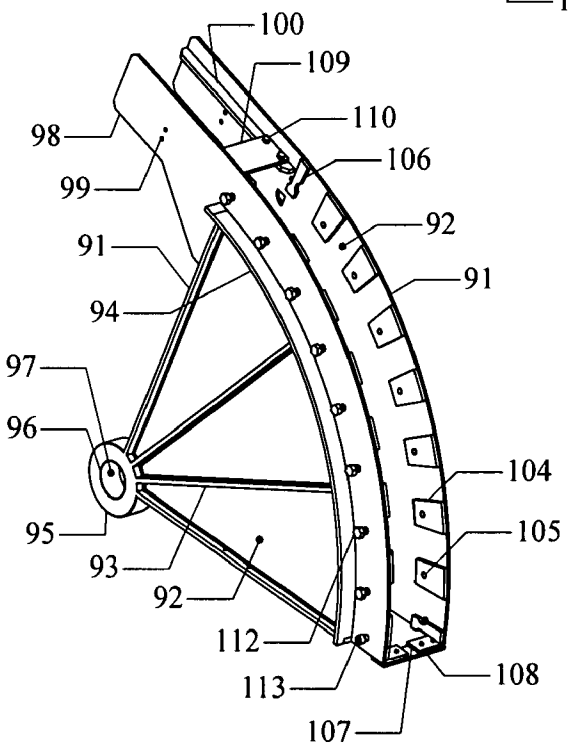
FIG. 9 is an oblique view of the frame of the tension enhancement means, with the mounting studs for its static sheaves shown.
Figure 8:
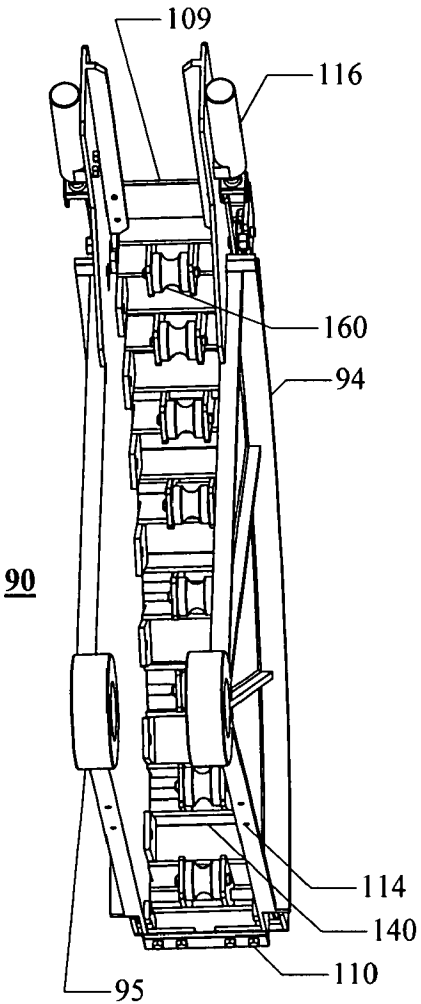
FIG. 8 is an oblique view of the tension enhancement means of the present invention showing its interior side which contacts the tubing.

Referring to FIG. 9, the interconnected side frames 91 of the holddown device 90 can be seen without most of the other constituent items of the holddown device. A side frame 91 is constructed with a core element which is a circularly arcuate segment of radially extending flat side plate 92. The side plate 92 has welded onto its outer side multiple equispaced radially extending transverse plate ribs 93. The radial ribs 93 extend between a transverse circumferential stiffening plate rim 94 welded onto the outer side of the side plate 92 and a hub 95. Two drilled and tapped holes are provided approximately midway on the length of the radial rib which is on the radial side of the side plate 92 opposed to the tangential extension 98 of the side plate.

The hub 95 is a thick wall axially short right circular cylindrical sleeve concentric with the center axis of the circularly arcuate side plate 92 and attached to the side plate so that it extends outwardly from the inner face of the side plate. A plain sleeve bearing 97 is mounted by being pressed into the bore 96 of the hub 95 of the side plate 91. The bore of the sleeve bearing 97 is a rotational close slip fit to the cylindrical shaft 64 of the wheel subassembly 61.

Extending coplanarly with the side plate 92 on one side is a tangential plate extension 98. Tangential extension 98 has one edge which is tangent to the outer arcuate face of the side plate 92 and typically has a radial thickness of approximately 25% of the radial thickness of the side plate. The projection of the tangential extension 98 is approximately twice its radial thickness. Drilled and tapped holes 99 are located in the tangential extension 98 so that the tension cylinder body 116 can be attached by machine screws 181. Tangential extension 98 is provided with a narrow transverse interior stiffener rib 100 mounted on its interior side surface so that it is parallel to the tangent outer edge of the extension. The transverse stiffener plate 100 is provided with two drilled and tapped holes to permit attachment of an inlet end cross tie plate 109 by means of a pair of tie plate attachment screws 110.

Lapped onto the interior face of each side frame 91 are an array of multiple trapezoidal radial guide plates 104 and an array of end radial guide plates 106. The guide plates 104 are used in the center of the array, while the guide plates 106 are used on the ends of the array. The guide plates 104 and 106 are configured so that when they are installed by welding onto a side plate 92 in a regularly spaced pattern, their adjacent inclined trapezoidal sides are parallel and equispaced. The width between adjacent plates 104 and between adjacent plates 104 and 106 is slightly more than the width between the outside of the cross plates 141 of the pulldown roller assemblies 140, thereby permitting the pulldown roller assemblies to have a slip fit in the resulting radial slots.

Multiple drilled and tapped sheave mounting stud mounting holes 105 are regularly spaced so that they are perpendicular to and penetrate both the side plate 92 and the guide plates 104. The sheave mounting stud mounting holes 105 penetrate the guide plates 104 on their radial midplanes and serve to mount the threadedly engaged static sheave mounting studs 112. End guide plates 106 are coped so that the end sheave stud mounting holes only penetrate the side plate 92. One extra hole 105 is provided on the side of the side plate 92 opposed to the tangential extension 98. This extra hole serves as a mounting for a cable end anchor stud 113.

A radially oriented and inwardly extending radial tab 107 having a pair of centrally located drilled and tapped holes is positioned adjacent the outer periphery of the side plate 92 on the radial edge of the side plate opposed to the edge with the tangential extension 98. Rectangular outlet end cross tie plate 108 and inlet end cross tie plate 109 are respectively attached to the tabs 107 and the interior stiffening ribs 100 of the two opposed side plates 92 by tie plate attachment screws 110, thereby spacing apart the mirror-image side plates so that their substantially flat interior sides are opposed.

The static sheave mounting studs 112 and the cable end anchor studs 113 are shoulder screws having upset heads, right circular cylindrical shanks, and reduced diameter threaded sections. The static sheave mounting studs 112 mount rotatable small static sheaves 180 on their cylindrical shanks and are threadedly engaged with the sheave stud mounting holes 105 so that the sheaves are mounted on the exterior side of the side plates 92. The static sheaves 180 are relatively thin grooved sheaves which are sized for use with the tension cable 170. The static sheaves can rotate, but they cannot translate. Although it is not shown herein, the static sheaves 180 may be provided with either plain bearings or needle bearings to reduce their rotational friction.

A cable end anchor stud 113 is threadedly engaged with each of the sheave stud mounting holes 105 which are adjacent the radial edge opposed to the tangential extension 98 side of each side plate 92. The cable end anchor stud 113 is first engaged with an anchored end eye 172 of a tension cable 170 before it is inserted into its hole 105 from the outside.

The body 116 of a double-acting single end hydraulic tension cylinder is threadedly mounted on the outside of each tangential extension 98 of a side plate by machine screws 181 engaged through tension cylinder mounting holes 99. The rod end of the cylinder body 116 is oriented so that the rod is tangential to the center of the groove of the closest static sheave 180 on the side of the sheave closest to the hub 95 of the side plate 92. The rod 117 of the tension cylinder is selectably reciprocable within the body 116 of the cylinder and has a distal clevis fitting 118 having a clevis pin 119. The clevis pin 119 is engaged with a cylinder end eye 171 of a tension cable 170.

The cylinders 116 are provided with hydraulic fluid by utilizing output from the power unit 24 on the trailer 20. The cylinders are mounted in a parallel hydraulic circuit and are controlled by the same directional valve (not shown). To apply tension to the cable attached to each cylinder, the rod end of each cylinder body 116 is pressurized. To release tension, the pressure on the rod end is vented.

A knee 120 is provided to extend between a rear inclined side of the tension wheel pedestal 72 and the radial rib 93 on the side opposed to the tangential extension 98 of each side frame 91. The knee 120 is constructed of a rectangular cross-section segment of structural tube having rectangular end plates which are inclined relative one plane of symmetry of the tube. One end plate projects outwardly beyond a first side of the tube, and the other end plate projects outwardly beyond the second side of the tube.

When the holddown device 90 is installed on the shaft 64 of the tension wheel, the radial ribs 93 which are on the side of the side frames 91 opposed to the tangential extensions 98 of the side plates 92 are maintained in a horizontal position by the knees 120. The two knees 120 are almost antisymmetrical, but the one on the lefthand side of the trailer 20 extends farther outwardly on its lower end and is strengthened by a gusset.

This dissymmetry is to accommodate the larger distance of the lefthand wheel pedestal side buttress 73 from the centerline of wheel 61 due to the presence of the driven sprocket 66 on the wheel shaft 64. Each knee 120 is attached by knee attachment screws 121 both to the rearward inclined face of a side wall 73 of the wheel pedestal 72 at knee mounting holes 76 and to a horizontal rib 93 of a side frame 91 at knee mounting holes 114. This prevents the side frame 91 from rotating relative to the pedestal 72, while the wheel 61 of the wheel tensioner 60 can still rotate.

Figure 12:
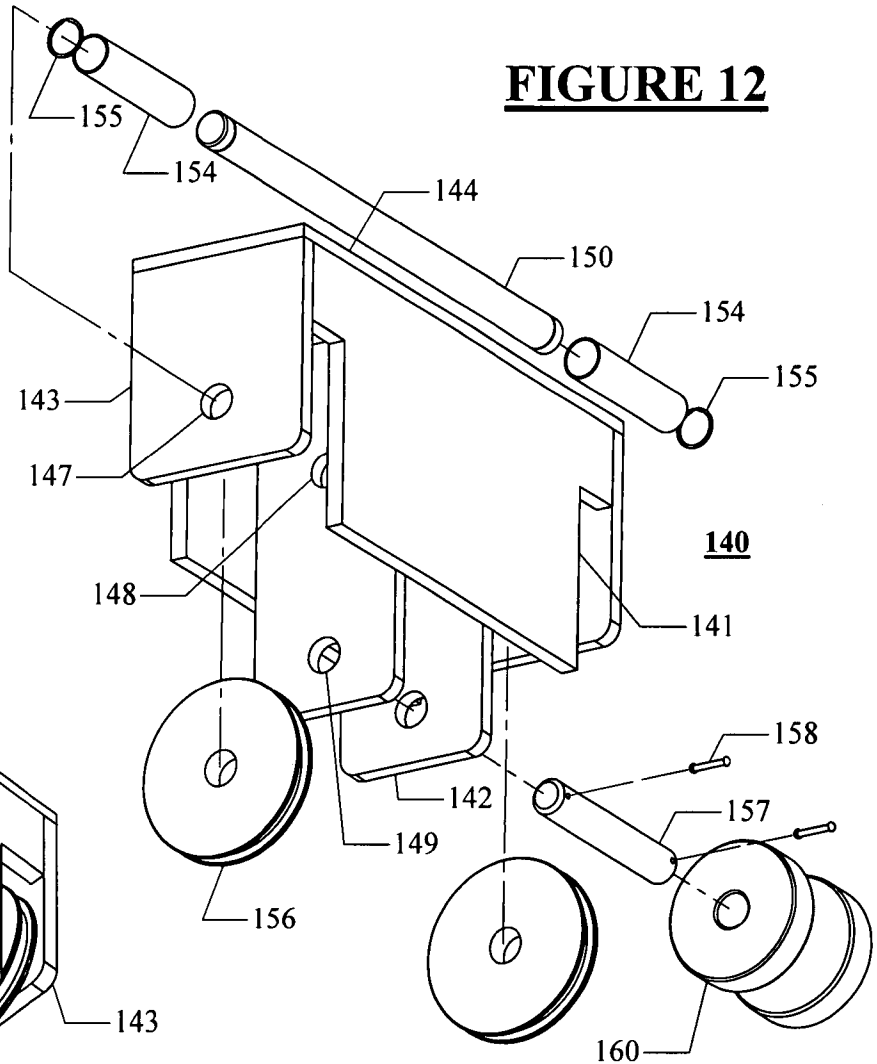
FIG. 12 is an exploded view of the radial forcing unit of FIG. 11.
Figure 11:
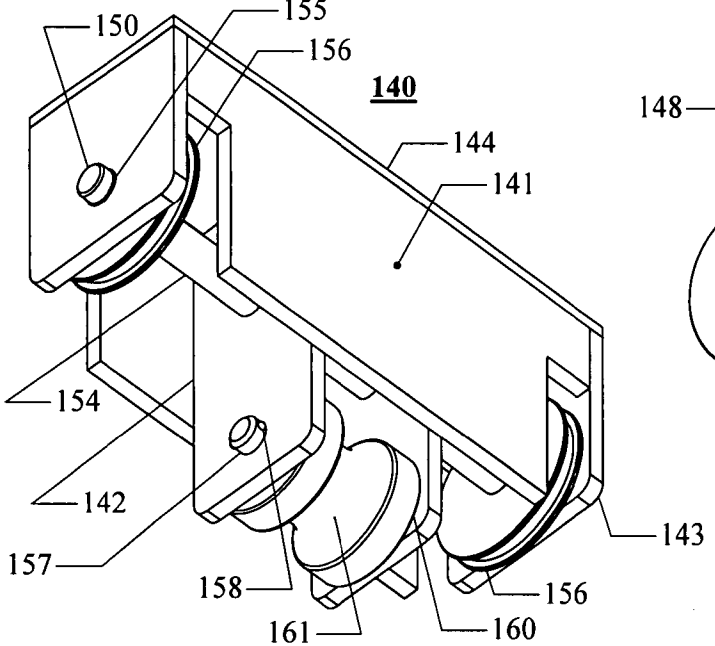
FIG. 11 is an oblique view of a radial forcing unit of the tension enhancement means.
Figure 13:
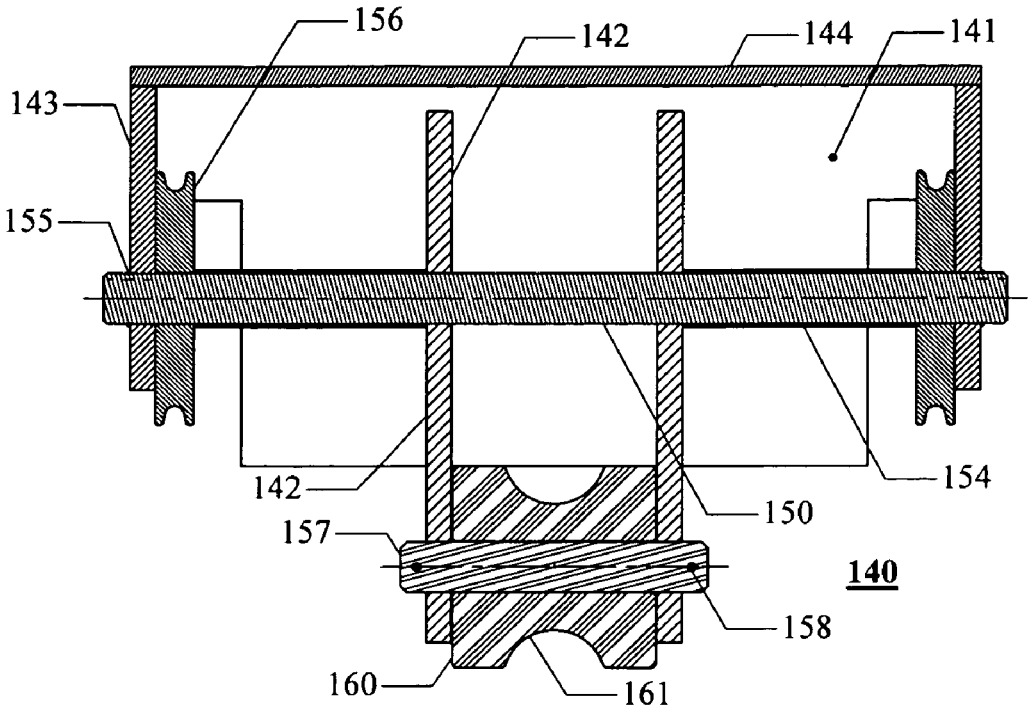
FIG. 13 is a transverse sectional view of the radial forcing unit of FIG. 11, with the section being taken on a radial plane for the tensioner wheel.
Figure 14:
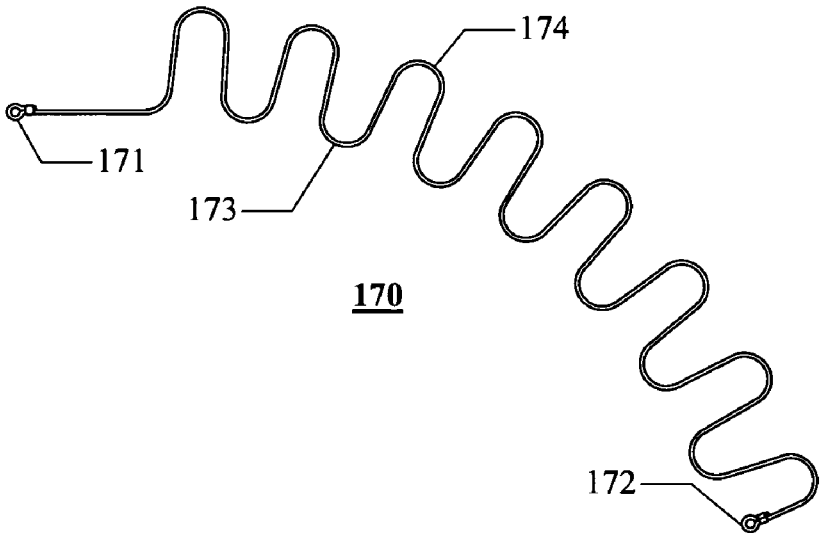
FIG. 14 is a side profile view of the tensioning cable showing its geometry when engaged with both the static sheaves and the sheaves of the radial forcing units of the tension enhancement means.

The pulldown roller assembly 140 is shown in FIGS. 11, 12, and 13. The pulldown roller assemblies 140 are reciprocable in the gaps between opposed pairs of either radial guide plates 104 or between a radial guide plate 104 and an end radial guide plate 106 on opposed inner faces of the side frames 91 of the holddown device 90. Because of the alignment of the guide plates 104 and 106, any reciprocation of the pulldown roller assemblies 140 will be radial with respect to the wheel 61 of the wheel tensioner 60.

The frame of a pulldown roller assembly 140 is assembled by welding from a pair of cross plates 141, a pair of middle radial plates 142, a pair of end radial plates, and a cap plate 144. The cross plate 141 has a wide tee shape, with the stem of the tee being relatively very wide and the cross bar of the tee having a height of approximately one quarter of the overall plate height. The width of the cross plate 141 is somewhat less than the gap between the side frames 91 of the holddown device 90. The middle radial plate 142 is an elongated rectangle plate having rounded lower corners and two vertically spaced apart holes 148 and 149 located in its vertical midplane and penetrating through the plate thickness. The middle radial plate 142 is longer than the cross plate 141 is tall. The upper hole is the sheave shaft hole 148, while the lower hole is the tubing roller shaft hole.

The end radial plate 143 is a rectangular plate having rounded lower corners and a single sheave shaft hole 147 located on its vertical midplane and penetrating through the plate thickness. Holes 147 and 148 have the same diameter. The width of the end radial plate 143 is equal to the width of the middle radial plate 142 plus twice the thickness of the cross plate 141. The cap plate 144 is an elongated rectangular plate which has a length equal to the width of the cross plate 141 plus twice the thickness of the radial end plate 143. The width of the cap plate 144 is the same as that of the radial end plate 143. The length of the cap plate is such that it has a close slip fit to the gap between the inner sides of the radial side frames 91 of the holddown device 90.

The pulldown roller assembly 140 has two transverse planes of symmetry. The cross plates 141, the middle radial plates 142, and the end radial plates 143 are all mounted with their top edges flush so that they can be abutted against and welded to the cap plate 144. The middle radial plates 142 are spaced apart perpendicular to the flats of the plates by slightly more than the width of the tubing roller 160. For the middle radial plates 142, the planes of their plates are normal to both the cap plate 144 and the cross plates 141. The end radial plates 143 are parallel and mounted at the outer ends of the cap plate so that the planes of their plates are perpendicular to both the cap plate 144 and the cross plates 141. The ends of the tees of the cross plates 141 are welded to the inner faces of the end radial plates 143 after they are abutted onto the long sides of the middle radial plates 142. The cross plates 141 are also welded to the middle radial plates 142 where they abut.

When assembled, the sheave shaft holes 148 of the middle radial plates 142 and the sheave shaft holes 147 of the end radial plates 143 are coaxial. The sheave shaft 150 is an elongated right circular cylindrical shaft which is a close slip fit to the sheave shaft holes 147 and 148. The sheave shaft 150 is slightly longer than the cap plate 144. A snap ring groove is located adjacent each of the ends of the sheave shaft, and Spirolox™ snap rings 155 can be inserted in to the grooves to abut the outer faces of the end radial plates 143 of the frame of the holddown device 140 and thereby retain the shaft. Two elongated right circular cylindrical sheave shaft spacer sleeves 154 are a close slip fit to the sheave shaft 150. The end sheaves 156 are relatively thin grooved sheaves which are rotatably mounted on the sheave shaft 150. Although it is not shown herein, the end sheaves 156 may be provided with either plain bearings or needle bearings to reduce their rotational friction. Both the end sheaves 156 and the static sheaves 180 are sized for use with the tension cable 170.

When assembled, an end sheave 156 is mounted on the shaft 150 inwardly of each of the inner faces of the end radial plates 143. A spacer sleeve 154 in mounted inboard of each of the end sheaves 156 and abutted against the outer face of its corresponding middle radial plate 142 in order to constrain the end sheaves to remain close to the end radial plates 143. For the assembled frame of the pulldown roller assembly 140, the two tubing roller shaft holes 149 in the opposed middle radial plates 142 are coaxial.

Elongated right circular cylindrical tubing roller shaft 157 is a close slip fit to the holes 149 and serves as an axle about which tubing roller 160 can rotate. Tubing roller shaft 157 has distal diametrical holes through which tubing roller shaft keeper pins 158 can be inserted in order to retain the shaft in place in its mounting bores. The tubing roller 160 is an annular right circular cylindrical tube with a semicircular groove cut at midlength to provide a tube contact face 161. As shown herein, the bore of tubing roller 160 is a close rotating slip fit to the tubing roller shaft 157, but as may be well understood by those skilled in the art, the tubing roller may be provided with needle bearings or other suitable types of bearing in order to improve roller operation.

The resulting structure of the pulldown roller assembly 140 is rigid and able to transfer forces from the end sheaves 156 to the tubing roller 160 and thence to the wall of the coiled tubing 16 which the tubing roller may contact. As mentioned previously, each of the pulldown roller assemblies 140 is inserted into a parallel sided slot formed on the interior side of a side frame 91 between either an adjacent pair of radial guide plates 104 or between an adjacent radial guide plate 104 and an end radial guide plate 106. Because the side frames 91 are parallel and are mirror images, each pulldown roller assembly 140 is then restrained in the corresponding slot on the opposed side frame 91. Because the length of the pulldown roller assembly 140 is a slip fit between the parallel side frames 91, the pulldown roller assemblies are constrained to reciprocate in a radial direction with respect to the wheel 61 of the wheel tensioner assembly 60. The grooves 161 of the tubing rollers are coplanar with the grooves 70 of the tubing support blocks 69 in the midplane of the wheel 61 due to the symmetry about the midplane of the wheel, the holddown device 90, and the pulldown roller assemblies 140.

Figure 10:
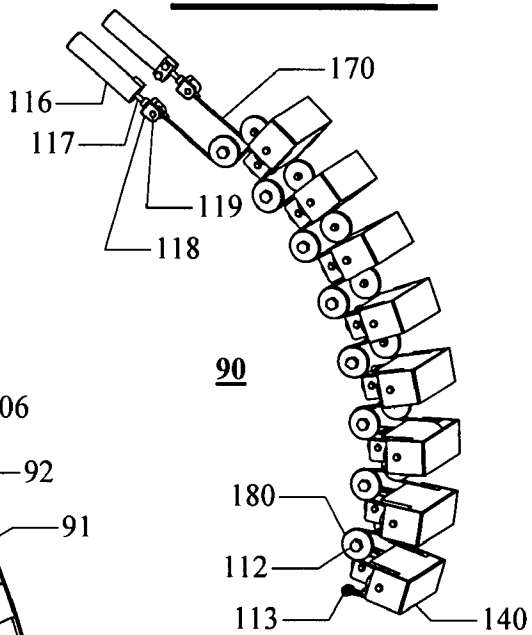
FIG. 10 is an oblique view of the movable portions of the tension enhancement means and the static sheaves, with the components shown in their working positions.

Referring to FIG. 10, the arrangement of the pulldown roller assemblies 140 relative to the static rollers 180, the tension cable 170, and the tension cylinder (components 116, 117, 118, and 119) can be seen. The relationship of the cable 170 to the static rollers 180 and the end sheaves 156 is further clarified by reference to FIG. 14. Cable 170 is provided with a cylinder end eye 171 at its first end and an anchor end eye 172 at its second end. On each half of the holddown device 90, the cylinder end eye 171 is engaged with the tension cylinder clevis pin 119, while the anchor end eye 172 is engaged with the cable end anchor stud 113. The cable 170 extends from the cylinder clevis pin 119 to the nearest static sheave, which it contacts over an approximately 90° arc and then is looped in an alternating pattern of approximately 180° loops 174 and 173 around the end sheaves 156 and the static sheaves 180. After passing over the last end sheave 156 of the pulldown roller assembly 140 farthest from the cylinder, the cable anchor end eye 172 is anchored by the cable end anchor stud 113.

Cable 170 acts on each of the mirror image end sheaves 156 to apply a radial load to each individual end sheave 156 of about twice the local tension in the cable. Thus, the overall radial load on an individual pulldown roller assembly 140 is slightly less than four times the tension applied to an individual cable since substantially the same pressure is applied to each tension cable 170. Approximately the same tension is applied through the cylinder rod 117 of each cylinder 116, so that the tension applied to the cylinder end eye 171 of the two tension cables 170 is about the same. This approximate equality of force applied to the each end sheave 156 is necessary to avoid cocking the pulldown roller assembly 140 between the radial plates 92 of the opposed side frames 91.

OPERATION OF THE INVENTION

When the coiled tubing 16 is being inserted into or being withdrawn from the well, high tractive forces must be applied to the tubing by a combination of the storage reel 30 and the wheel tensioner 60. It is highly desirable to avoid having the storage reel 30 provide much of the tractive force to the tubing, since this increases the crushing force on the reel hub and also tends to damage the tubing where the wraps cross over each other.

For a wheel tensioner without the holddown device, having some tubing tension on both sides of the wheel tensioner is necessary in order to develop frictional forces between the wheel tensioner and the tubing. In such a case, higher tubing tension on the side of the wheel tensioner where the tube is incoming markedly enhances the tractive forces which may be applied to the tubing by the wheel. However, in actual coiled tubing operations, it is often necessary to force the tubing 16 to enter the well against pressure retained by the pressure retaining gland 14. A wheel tensioner without a holddown device in such a case does not function well. Provision of a holddown device for a wheel tensioner overcomes this operational difficulty.

The holddown device 90 functions by causing an arcuate array of tubing rollers 160 to press radially inwardly against tubing 16 deployed in the grooved tubing support blocks 69, thereby inducing an increased reactive normal force of the tubing support blocks against the tubing. The increased normal force between the tubing 16 and the tubing support blocks 69 of the wheel tensioner 60 increases the amount of static frictional force which can be developed between the support blocks and the tubing.

Tension is induced in the tubing 16 passing over the wheel tensioner 60 by these static frictional forces. Neglecting frictional and material cyclical hysteric losses in the bearings 78 and support blocks of the wheel tensioner 60 and the rollers 160 and their rotational mountings in the holddown device 90, the torque applied to the tensioner wheel 60 is expressed at the contact zone between the tubing 16 and the support blocks 69 as the product of the change of tension in the tubing 16 and the radius of the tubing over the tensioner wheel.

The tubing rollers 160 of the holddown device 90 are each mounted in an individual symmetrical pulldown roller assembly 140. The radially inward forces applied to the pulldown roller assemblies 140 are applied by a pair of tensioned cables 170, one of which is looped around and acts on each of the two end sheaves 156 located on the distal end of each of the pulldown roller assemblies proximal the two end plates 143. The radial force on each end sheave 156 is equal to the radial inward component of the vector sum of the tensions of the cable 170 on the two sides of the unsupported cable tangent to that end sheave. The overall radial inward force on each pulldown roller assembly 140 and hence its tubing roller 160 is the sum of the radial inward forces on the two end sheaves 156 of the assembly.

To insert the tubing 16 between the tubing support blocks 69 of the wheel 61 and the tubing rollers 160 of the holddown device 90 of the wheel tensioner 60, the rod 117 of the tension cylinder body 116 is extended so that the cables 170 are not tensioned. This permits the end of the tubing to displace the pulldown roller assemblies 140 radially outwardly, thereby permitting passage of the tubing.

In order to enhance the tractive forces applicable to the tubing 16 by the tensioner wheel 61, the rod 117 of the tension cylinder body 116 is retracted sufficiently to cause the tubing rollers 160 of the pulldown roller assemblies 140 to contact and bear on the tubing. Increasing the rod end pressure on the retracting cylinder increases the tension in the cable 170, causing each pulldown roller assembly 140 to be forcibly urged into contact by the combination of twice the local cable tensions around each of the end sheaves 156. This contact force of the tubing rollers 156 on the tubing 116 in turn enhances the total contact force between the tubing and the tubing support blocks 69. It is noted herein that the tubing rollers 160 do not exert tractive forces on the tubing 16 except for substantially negligible rotating frictional resistances.

While the axial tension in the tubing 16 adjacent the zone of contact of the tubing roller 160 with the tubing strongly impacts in an additive way the local radial contact load between the tubing and the support blocks 69, in most cases it is necessary to have the holddown forces applied by the cables 170 and the pulldown roller assemblies 140 in order to produce sufficient tractive force on the tubing from its contact with the wheel tensioner 61. The tractive force which may be applied to the tubing 16 is equal to the integral over the contact arc length of the product of the contact force multiplied by the coefficient of friction between the tubing support block 69 and the tubing. Since only the tensioner wheel 61 is rotationally powered, only it can transfer tension into the tubing 16 by frictional shear forces.

The reeving of the tension cable 170 in alternating loops 173 and 174 over the static sheaves 180 and the end sheaves 156, respectively, along with the ability of the cable to be tensioned by a single cylinder provides an economical and highly efficient means of applying radially inward contact forces to the tubing 16. These forces then increase the contact force between the tubing 16 and the tubing support blocks 69 of the tensioner wheel 61, thereby enhancing the frictional forces applicable as tractive force to the tubing.

The sections of the cables 170 tangent to each of the end sheaves 156 extend approximately radially relative to the wheel tensioner 60 and the holddown device 90. With the relatively small diameter of the end sheaves relative to the tensioner wheel 61 and the close spacing between the pulldown roller assemblies 140, the force on each end sheave 156 is slightly less than twice the local tension in the cable.

The construction and assembly of the holddown device is simple and inexpensive. Assembly and servicing of the holddown device 90 is also eased by its simple construction and accessibility. Provision of good rotary bearings for both the tubing rollers 160 and the sheaves 156 and 180 greatly reduces the frictional losses of cable tension between the cylinder 116 and the cable end anchor studs 113.

The configuration of various elements of the holddown device of the present invention can be varied without departing from the spirit of the invention. For example, the sheaves and tubing contact rollers can be provided with needle bearings and the structure of the side plates altered without departing from the spirit of the invention. Similarly, the combination of the holddown device and a wheel tensioner can be applied to cables or solid rods or elongate material of a variety of cross-sections and materials of construction. Although the present invention and its advantages have been described in detail, it should be understood that various changes, substitutions and alterations can be made herein without departing from the spirit and scope of the invention as defined by the appended claims.

What is claimed is:

1. A wheel tensioner assembly for applying tension to a string of coiled tubing during its injection into and withdrawal from a wellbore, the wheel tensioner assembly comprising:

(a) a selectably rotatable tensioner wheel having a circumferential contact surface for interacting with a first side of the coiled tubing;

(b) a holddown device comprising (i) two side frames, wherein each side frame mounts a set of plate guides, and (ii) a plurality of roller mounting structures, wherein each roller mounting structure mounts a contact roller, a first end sheave on a first side of the contact roller, and a second end sheave on the second side of the contact roller and wherein each roller mounting structure is reciprocably positioned between two plate guides of each side frame; and (c) a biasing mechanism for urging said contact rollers radially inwardly to bear against the second side of the coiled tubing and press the coiled tubing against the circumferential contact surface of the tensioner wheel, wherein the biasing mechanism includes a first tensioning cable in communication with the first end sheave of each roller mounting structure and a second tensioning cable in communication with the second end sheave of each roller mounting structure.

2. The wheel tensioner assembly of claim 1, wherein tensioning the first and second tensioning cables biases the contact rollers against a second side of the coiled tubing.

3. The wheel tensioner assembly of claim 2, wherein the the tension applied to the first tensioning cable is equal to the tension applied to the second tensioning cable.

4. The wheel tensioner assembly of claim 3, wherein tensioning the first and second tensioning cables applies an equal load to the first side of the contact roller and to the second side of the contact roller.

5. The wheel tensioner assembly of claim 1, wherein each of the side frames mounts a set of frame sheaves.

6. The wheel tensioner assembly of claim 5, wherein the first tensioning cable is in communication with the set of frame sheaves mounted on one side frame and the second tensioning cable in communication with the set of frame sheaves mounted on the second side frame.

7. The wheel tensioner assembly of claim 1, wherein the the set of plate guides mounted on the first side frame are equal in number to the set of plate guides mounted on the second side frame.

8. A wheel tensioner assembly for applying tension to a string of coiled tubing during its injection into and withdrawal from a wellbore, the wheel tensioner comprising:

(a) a tensioner wheel having a circumferential contact surface for interacting with a first side of the coiled tubing;

(b) a holddown device attached to the tensioner wheel, the holddown device having (i) a first side frame mounting a set of first frame sheaves on an exterior side of the first side frame and a set of first plate guides on an interior side of the first side frame, (ii) a second side frame mounting a set of second frame sheaves on an exterior side of the second side frame and a set of second plate guides on an interior side of the second side frame, and (iii) a plurality of roller mounting structures, wherein each roller mounting structure mounts a contact roller, a first end sheave on a first side of the contact roller, and a second end sheave on the second side of the contact roller and wherein a first side of each roller mounting structure is reciprocably positioned between a pair of first plate guides and a second side of each roller mounting structure is reciprocably positioned between a pair of second plate guides; and (c) a biasing mechanism for urging the contact rollers radially inwardly to apply a force normal to a second side of the coiled tubing and press the coiled tubing against the circumferential contact surface of the tensioner wheel, wherein the biasing mechanism includes a first tensioning cable in communication with the first end sheave of each roller mounting structure and the set of first frame sheaves and a second tensioning cable in communication with the second end sheave of each roller mounting structure and the set of second frame sheaves.

9. The wheel tensioner assembly of claim 8, wherein tensioning of the first and second tensioning cables biases the contact rollers against a second side of the coiled tubing.

10. The wheel tensioner assembly of claim 9, wherein tensioning the first and second tensioning cables applies an equal load to the first side of the contact roller and to the second side of the contact roller.

11. The wheel tensioner assembly of claim 8, wherein the set of first frame sheaves are equal in number to the set of second frame sheaves.

12. The wheel tensioner assembly of claim 8, wherein the set of first plate guides is equal in number to the set of second plate guides.

13. The wheel tensioner assembly of claim 8, wherein the first tensioning cable is attached to a first hydraulic cylinder and the second tensioning cable is attached to a second hydraulic cylinder.

14. The wheel tensioner assembly of claim 13, wherein the tension applied to the first tensioning cable by the first hydraulic cylinder is equal to the tension applied to the second tensioning cable by the second hydraulic cylinder.

15. A wheel tensioner assembly for applying tension to a string of coiled tubing during its injection into and withdrawal from a wellbore, the wheel tensioner comprising:

(a) a tensioner wheel rotatably mounted on a wheel pedestal, wherein the tensioner wheel has a rim, a shaft, a wheel sprocket mounted on the shaft, and a circumferential arcuate contact surface for interacting with a first side of the coiled tubing;

(b) a holddown device attached to the shaft of the tensioner wheel, the holddown device having (i) a first side frame mounting a first hydraulic cylinder, a set of first frame sheaves on an exterior side of the first side frame, and a set of first plate guides on an interior side of the first side frame, (ii) a second side frame mounting a first hydraulic cylinder, a set of second frame sheaves on an exterior side of the second side frame, and a set of second plate guides on an interior side of the second side frame, and (iii) a plurality of roller mounting structures, wherein each roller mounting structure mounts a contact roller, a first end sheave on a first side of the contact roller, and a second end sheave on the second side of the contact roller and wherein a first side of each roller mounting structure is reciprocably fitted between a pair of first plate guides and a second side of each roller mounting structure is reciprocably fitted between a pair of second plate guides; and (c) a first tensioning cable in contact with the first end sheave of each roller mounting structure and the set of first frame sheaves;

(d) a second tensioning cable in contact with the second end sheave of each roller mounting structure and the set of second frame sheaves whereby when an equal local tension is applied to the first and second tensioning cables an equal lateral load is placed on the first and the second end sheaves of the roller mounting structure that is then transferred to a second side of the coiled tubing.

16. The wheel tensioner assembly of claim 15, wherein the radial load on each first end sheave is about twice the local tension applied to the first tensioning cable and the radial load on each second end sheave is about twice the local tension applied to the second tensioning cable.

17. The wheel tensioner assembly of claim 15, wherein a radial inward force applied to each roller mounting structure is equal to a sum of radial inward forces applied to the first and second end sheaves by the first and second tensioning cables.

18. A wheel tensioner assembly for applying tension to a string of coiled tubing during its injection into and withdrawal from a wellbore, the wheel tensioner comprising:

(a) a selectably rotatable tensioner wheel having an exterior circumferential contact surface for interacting with a first side of the coiled tubing; and (b) a holddown device attached to a shaft of the tensioner wheel, the holddown device comprising a plurality of roller mounting structures, wherein each roller mounting structure mounts a contact roller and positions the contact roller radially outward of the circumferential contact surface and wherein a first end sheave is mounted on each roller mounting structure on a first side of the contact roller and a second end sheave is mounted on an opposed side of each contact roller; and a selectably engaged biasing mechanism for urging said contact rollers radially inwardly to bear against a second side of the coiled tubing and press the coiled tubing against the circumferential contact surface of the tensioner wheel, wherein the biasing mechanism includes a first tensioning cable in communication with the first end sheave and a second tensioning cable in communication with the second end sheave.

19. The wheel tensioner assembly of claim 18, wherein the first tensioning cable is attached to a first hydraulic cylinder and the second tensioning cable is attached to a second hydraulic cylinder such that tensioning the first and second tensioning cables biases the contact rollers against the second side of the coiled tubing.

20. The wheel tensioner assembly of claim 19, wherein the tension applied to the first tensioning cable by the first hydraulic cylinder is substantially equal to the tension applied to the second tensioning cable by the second hydraulic cylinder.

* * * * *